United States Patent [19]

van Leer

[11] 4,005,878

[45] Feb. 1, 1977

[54] METHOD AND DEVICE FOR THE ASSESSMENT OF SIGNATURES FOR FORGERIES

[75] Inventor: Willem van Leer, Haifa, Israel

[73] Assignee: Hydrophilics International, Inc., New York, N.Y.

[22] Filed: Dec. 10, 1975

[21] Appl. No.: 639,286

[30] Foreign Application Priority Data

July 28, 1975 United Kingdom ..... 31556/75
Sept. 26, 1975 United Kingdom ..... 39578/75

[52] U.S. Cl. ..... 283/8 R; 73/432 R; 282/20 A

[51] Int. Cl.[2] ..... B42D 15/00; B42D 19/00

[58] Field of Search ..... 35/2, 22 R, 36, 37; 73/432 R; 101/369; 282/19 R, 19 A, 20 R, 20 A, 21 R, 21 A; 283/6, 7, 8 R, 8 A, 8 B, 17

[56] References Cited

UNITED STATES PATENTS

| | | | |
|---|---|---|---|
| 732,700 | 7/1903 | Bellamy | 282/20 A |
| 2,470,260 | 5/1949 | Oliver | 282/21 A |
| 2,952,080 | 9/1960 | Avakian et al. | 35/2 |
| 3,113,461 | 12/1963 | Peters | 73/432 R |
| 3,282,720 | 11/1966 | Oleksiw | 283/8 R X |
| 3,480,911 | 11/1969 | Danna | 73/432 R X |
| 3,487,210 | 12/1969 | Hubert | 283/7 X |
| 3,721,128 | 3/1973 | Thurman | 73/432 R |
| 3,740,872 | 6/1973 | Mayo | 35/37 |
| 3,818,615 | 6/1974 | Jimenez | 35/37 |

*Primary Examiner*—William H. Grieb
*Attorney, Agent, or Firm*—McAulay, Fields, Fisher & Goldstein

[57] ABSTRACT

A method and device are provided which cause the distortion of a signature being made on a check, credit card slip, etc. The distortion provided allows for better verification of the signature. The distortion can be an elongation of the signature, reversal of the signature, or other suitable form of forming a non-standard signature by which the authenticity of the signature can be verified.

10 Claims, 3 Drawing Figures

FIG. 1
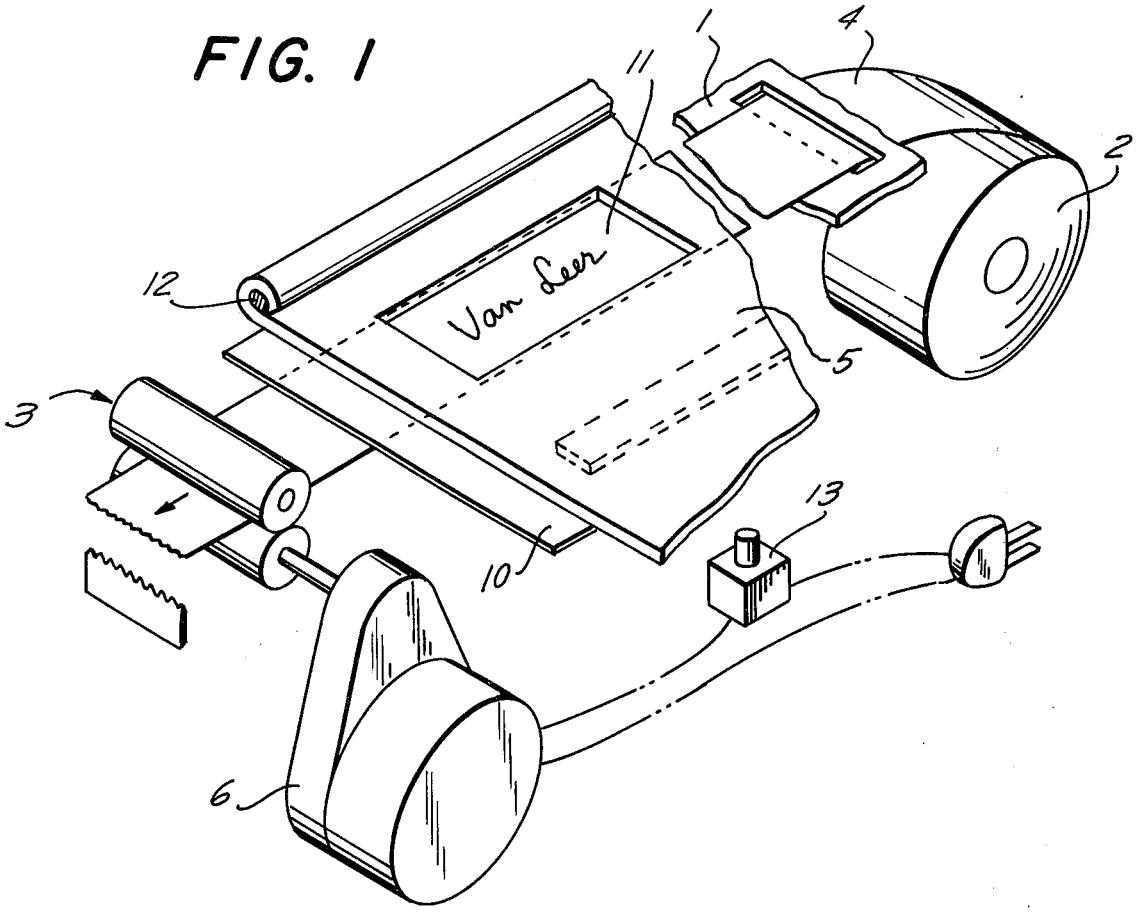
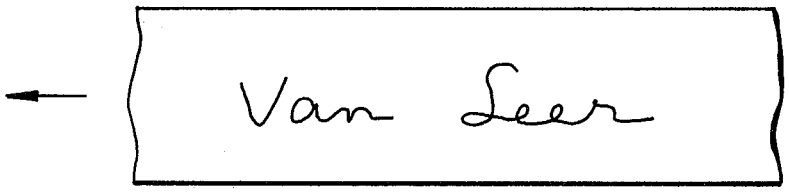
FIG. 2
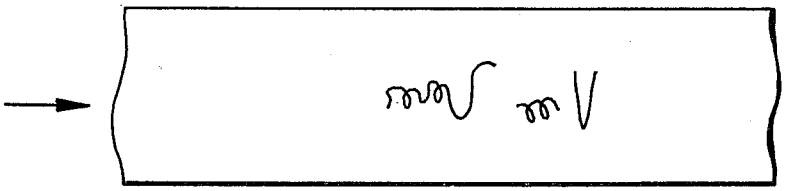
FIG. 3

METHOD AND DEVICE FOR THE ASSESSMENT OF SIGNATURES FOR FORGERIES

BACKGROUND OF THE INVENTION

Immense sums of money are lost every year as a result of fraudulent use or conversion of lost or stolen credit cards and travellers checks. All that it is necessary for the defrauder to do is to forge in front of the cashier acccepting the card or check a reasonable copy of the rightful owner's signature which already appears on the card or check. Unless the forged signature is very bad or particularly labored in execution the cashier will usually have no reason to suspect that a fraud is being committed and will carry out the transaction as normal.

There are established techniques and equipment for determining whether or not a signature is a forgery but these are of such a nature that it is totally impractical to make them available at every place where credit cards and travellers checks may be used. A simple forgery detecting technique which it is both economic and practical to make readily available and which will enable a cashier to determine more easily whether or not a signature has been forged, would therefore be enormously useful and beneficial.

SUMMARY OF THE INVENTION

The present invention is directed to provision of apparatus and technique for use in detecting forgeries, both the apparatus and technique being economical and involving equipment which can be made readily available. In essence, the present invention is directed to arranging for the person wishing to make a transaction using a credit card or travellers check to sign the receipt or check over a paper strip which is moving relative to the receipt or check so that a carbon or similar record of the signature is produced on the strip. The strip can be moved in any direction relative to the direction of signature. In many cases, it will prove desirable to move the strip in a direction opposite to that of signature so that the result is an elongation of the signature and an emphasizing of discontinuities. In other cases, it is desirable that the strip move in the same direction in which the document is being signed, the result being a compression or reversal of the signature. The reversed signature can be described as a hieroglyphic.

Because of the movement of the strip while the signature is executed the recording on the strip will be distorted in the direction of movement but the important thing is that any pauses or breaks in the flow of the pen when making the signature will show up as discontinuities in the form of steps or gaps in the recording. Of course, there will often be discontinuities in the recording of an authentic signature due to natural pauses and the pen being lifted from the writing surface in certain places, but these will invariably occur at recognized positions and almost never in the middle of a letter stroke. Consequently a cashier can easily be trained to spot unacceptable discontinuites, either in number or in position, in a recording, thereby arousing a suspicion that the signature may have been forged. The cashier should then require satisfactory authentication or proof of identity by the person signing before completing the transaction. Normally, most people sign their names within a given time range, so that a limit may be defined within which the length ratio of the distorted recording to the actual signature will normally fall. Thus, if the ratio for any particular recording is greater than the set limit this may be taken by the cashier as another reason for a more careful consideration of the transaction.

It is thought that adoption of this technique could drastically reduce the financial losses due to fraudulent use of lost or stolen credit cards and travellers checks. The technique could also prove useful when ordinary checks and other security documents have to be signed and there is not necessarily an authentic signature available for comparison.

It will obviously be appreciated that the strip can effectively be moved in any direction relative to the signature, including diagonally, perpendicularly, in a helix, etc. The use of these other directions, of course, involves more complicated machinery than would be required to move the strip in the same direction as, or in a direction opposite to, the direction of signature.

Variations are also possible in the manner in which the technique and apparatus of the present invention are employed. For example, when a credit card is issued to its holder, rather than the blank space which is normally left for the holder's signature, the reversed hieroglyphic, elongated, or compressed signatures formed in accordance with the present invention may be placed on the credit card to aid in verification. Similarly, with a travellers check, which is signed upon issuance, the signature placed on the check may be the distorted signature formed according to the present invention, rather than the normal signature, as presently employed.

The distorted signature formed according to the present invention, at the time it is made for verification, i.e. the cashing of the travellers check or the purchase with a credit card, can be formed directly at the cashier's station, or can be transmitted, by known techniques, to a remote location where signature verification is carried out for a number of cashier's stations. For example, in a department store with numerous cashiers locations, the remote reception of the distorted signature may be a more effective method of employing the present invention.

BRIEF DESCRIPTION OF THE DRAWINGS

In the accompanying drawings:

FIG. 1 is a perspective view, partially broken away, of an apparatus employable for the formation of distorted signatures;

FIG. 2 shows an elongated signature formed according to the present invention; and FIG. 3 shows a reversed signature formed according to the present invention.

DESCRIPTION OF THE PREFERRED EMBODIMENTS

Referring to the accompanying drawings, a view of an apparatus for use in forming the distorted signature in accordance with the present invention, is illustrated. The apparatus includes a base or casing 1 within and upon which are found the various operative parts of the apparatus. Within the casing are mounted a paper roll 2 and a drive means 3, the latter moving the paper strip 4 from the roll 2. As illustrated in FIG. 1, the drive means 3 is a pair of nip rolls, driven by means, such as an electric motor 6, which move the paper strip 4 from right to left. It will be appreciated that if the driving means and paper roll are reversed, relative to the illustration of FIG. 1, the paper strip will be driven from left to right.

The paper strip 4 moves over the top of casing 1, which provides a support for the strip and allows for the impression of the distorted signature. A document 10 which is to be signed, so that the signature can be verified, is place in such a position that the signature area will overlie a portion of paper strip 4. The document is placed under a plate 5 having an opening 5 within which the actual signature is made. The plate 11 is generally movable to allow for easy insertion and removal of document 10.

The movable plate may, itself, be spring loaded, as illustrated at 12, or it may have a clamp which is spring loaded, for purposes of holding the document to be signed in proper position for transmission of the signature to the paper strip.

In operation, the document 10 to be signed, which may be a check, credit card form, etc., is placed under the movable plate and held in position such that the signature area underlies a window which is in juxtaposition to the paper strip. A switch is actuated, either manually by means of a standard electrical switch 13 or by depression of the plate due to the pressure of the hand resting upon it, through a pressure actuated electrical switch (not shown). In either event, actuation of the switch causes movement of the driving means so as to draw the paper strip 4 off of the roll 2. The strip is thus moved as the document is being signed.

Employing an apparatus constructed as shown in FIG. 1, the strip is thus moved from right to left as the signature is accomplished or in the opposite direction from the direction of signature. The result, is an elongational distortion of the signature, resulting in a signature of the type shown in FIG. 2. With movement of the paper strip in the opposite direction, i.e. from left to right, the paper is obviously moved in a direction which is the same as that of signature, which results in a compression, or even reversal, of the signature. If the speed of movement of the paper strip, in this situation, is not properly established and standarized, the various letters will be superimposed upon each other; then the result will be of little, or no, value in detecting a forgery. With proper control of the speed, the signature can be reversed, though compressed, into the hierogylphic form illustrated in FIG. 3. In this form, it becomes of great value in detecting a forgery.

The paper strip 4 has been defined, merely, as a moving paper strip. Obviously, some means must be provided for forming a visible image on that strip. This can be accomplished in a number of ways. If desired, a piece of carbon paper may be placed below the cover sheet, just described, or between the document being signed and the moving paper strip. Further, a strip of carbon paper or ribbon can be moved in synchronization with the moving paper strip. Under those circumstances, it is best to have the carbon paper strip or ribbon supplied along with the paper strip 4.

The preferable means for accomplishing a visible image on the moving strip, however, is to have the strip formed of a paper which has a sensitized coating which becomes a visible marking under the pressure applied by the tip of the pen. This type of paper is frequently described as "carbonless" paper and a suitable form is manufactured by NCR under various tradenames, the coating being an encapsulated dye. A separate sheet of carbon paper or a separate ribbon is unnecessary when this type of paper is employed.

While the invention has been described with regard to a paper strip 4, it is apparent that the distorted signature can be formed on other types of materials, or on other forms of paper, requiring, only, suitable mechanism within the device to accommodate the other types of surfaces or forms. For example, a paper sheet, of any desired size, can be employed. Obviously, in this case, a continuous material, such as the paper strip, is not used, but an individual sheet is inserted and moved for each signature. Similarly, particularly where no permanent record of the distorted signature is required, a device on which a transitory visible image is formed can be employed. Such a device may be of the form of the well-known children's "Magic Slate," which includes a stiff backing layer on which a coating is placed, and a movable, acetate sheet on top of the coating. When pressure is applied to this acetate coating, a visible image is formed, but is easily removed by separating the acetate sheet from the coating. The entire structure of this device would be moved relative to the document upon execution of the signature.

The driving means 3 has been described as a pair of nip rolls. It will be appreciated that both nip rolls may be driven, or that only one nip roll need be driven, the other roll being mounted for free rotation or, in fact, being replaced by a fixed bearing surface. Alternately, in place of the nip rolls, and when employing a paper strip which is provided with perforations, the driving means can be a sprocket wheel.

The driving means 3 can, in either event, be driven by any suitable arrangement as, by an electric motor either directly or through a gearing or pulley arrangement. It is important that the driving means be moved at a constant speed so that the reversal achieved is the same, or essentially the same, for each signature, or that the elongation and gaps provided are the same. However, it may prove advantageous, in some instances, to provide more than one speed for the driving means. That, of course, is easily accomplished by employing a two-speed motor, two different sets of interchangeable gears, or a differential pulley arrangement.

The apparatus has been described as incorporating driving means to either move the paper strip from left to right, or from right to left. It will, of course, be appreciated that two different driving means can be provided in the same apparatus, with alternate arrangements for insertion of the paper roll 2, so that the apparatus can be employed either for signature elongation, or for signature compression, as desired.

The elongated, compressed, or reversed hierogylphic signature, or any other type of distorted signature formed according to the method of the present invention, can be the actual form which is provided for checking against. Under these circumstances, as indicated the distorted signature is the one placed on the credit card or the travellers check, for example. In this manner, the potential forger has no true signature with which to compare and that may, in itself, proof a sufficient deterrent to an attempted forgery. In the case of a credit card verification, for example, the distorted signature may be placed on a magnetic tape which is employed to engrave the distorted signature on the credit card at the time of its issuance.

An apparatus and method for use in discouraging forgeries has thus been described. The specific embodiment shown and described should not be considered as limiting, but the invention should be considered as limited only by the appended claims.

I claim:

1. An apparatus for use in forming a distorted signature so as to prevent forgery comprising:

a. a moving surface on which a visible image can be formed;

b. means to provide a visible image on said moving surface in response to application of pressure;

c. means to move said moving surface relative to a document being signed during the process of signing; and d. means for positioning a document to be signed over said moving surface and said visible image forming means.

2. The apparatus of claim 1 wherein the moving surface is a moving paper strip.

3. The apparatus of claim 2 wherin said strip, visible image forming means, and driving means are mounted within a casing, said casing having an opening provided for transmittal of pressure from said document being signed to said paper strip.

4. The apparatus of claim 2 wherein said paper strip is provided with a coating for formation of a visible image.

5. The apparatus of claim 1 wherein said means for forming a visible image is carbon paper.

6. The apparatus of claim 1 wherein said driving means is a pair of nip rolls.

7. A method for forming a distorted signature for use in preventing forgeries comprising:

a. providing a document to be signed;

b. moving a means on which a visible image is to be formed relative to said document to be signed during the process of signing; and c. forming a visible image on said moving means during the process of signature, the visible image being distorted relative to the actual signature.

8. The method of claim 7 wherein the moving means is a paper strip.

9. The method of claim 8 wherein the paper strip is moved in the same direction as the direction of signature.

10. The method of claim 8 wherein the paper strip is moved in a direction opposite to the direction of signature.

* * * * *